US005980439A

United States Patent [19]

Johnson et al.

[11] Patent Number: 5,980,439

[45] **Date of Patent: *Nov. 9, 1999**

[54] FOLDING APPARATUS

[75] Inventors: Steve Johnson, Antelope; Robert L. Fehringer, Camino; Chris Jones, Folsom, all of Calif.

[73] Assignee: Output Technology Solutions of California, Inc., El Dorado Hills, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/588,715

[22] Filed: Jan. 19, 1996

[51] Int. Cl.[6] ..... B31F 1/10; B65H 45/14

[52] U.S. Cl. ..... 493/14; 493/18; 493/29; 493/421

[58] Field of Search ..... 493/419, 420, 493/421, 9, 10, 11, 13, 14, 16, 17, 18, 19, 20, 23, 25, 28, 29

[56] References Cited

U.S. PATENT DOCUMENTS

| | | | |
|---|---|---|---|
| 2,997,295 | 8/1961 | Beck . | |
| 3,698,705 | 10/1972 | Funk et al. . | |
| 3,975,009 | 8/1976 | Brown . | |
| 4,621,966 | 11/1986 | Luperti . | |
| 4,668,212 | 5/1987 | Kotani | 493/216 |
| 4,834,695 | 5/1989 | Boblit et al. . | |
| 4,850,945 | 7/1989 | Whittenberger . | |
| 5,015,222 | 5/1991 | Bunch, III | 493/11 |
| 5,095,682 | 3/1992 | Steidinger | 493/216 |
| 5,104,366 | 4/1992 | Bunch | 493/23 |
| 5,183,246 | 2/1993 | Edwards et al. . | |
| 5,246,415 | 9/1993 | Fuss | 493/28 |
| 5,437,596 | 8/1995 | Bogdan et al. | 493/420 |
| 5,437,597 | 8/1995 | Boughton et al. | 493/420 |
| 5,441,244 | 8/1995 | Bartoes | 270/45 |
| 5,445,368 | 8/1995 | Lester et al. . | |
| 5,514,066 | 5/1996 | Monaco | 493/25 |

*Primary Examiner*—Stephen F. Gerrity
*Attorney, Agent, or Firm*—James M. Ritchey

[57] ABSTRACT

A folding apparatus for folding a plurality of sheets of multiple lengths such as mail statements, which includes a plurality of folder rollers, one or more folder gates, and a kicking plate associated with one of the folder gates. An input transport system provides statements to the folder rollers, and an exit transport system receives folded statements therefrom. A system controller monitors movement of statements through the folder rollers and folder gates of the apparatus by a plurality of sensors, and directs operation of the kicker gate at the appropriate time to push or eject the folded statements from the folder rollers. The action of the kicker plate prevents undesirable folding of the tips of shorter sheets in the statement while folding the longer sheet or sheets of the statement.

6 Claims, 5 Drawing Sheets

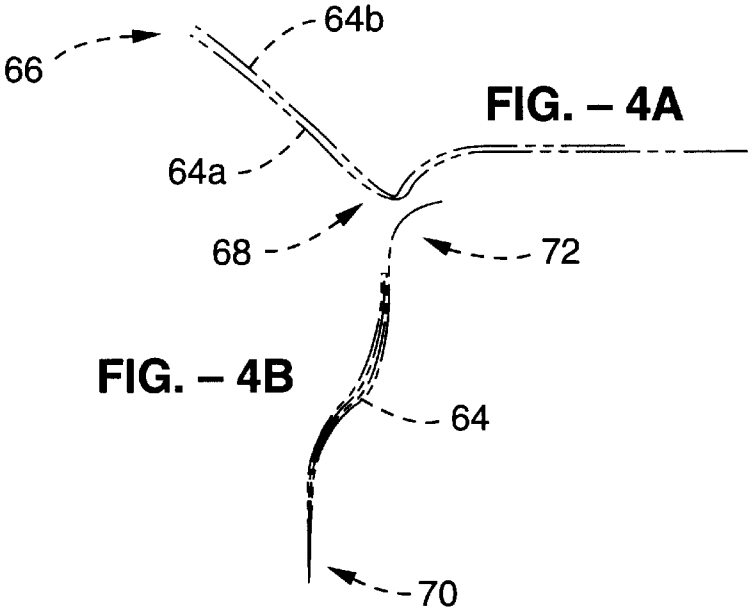
FIG. – 4A
FIG. – 4B
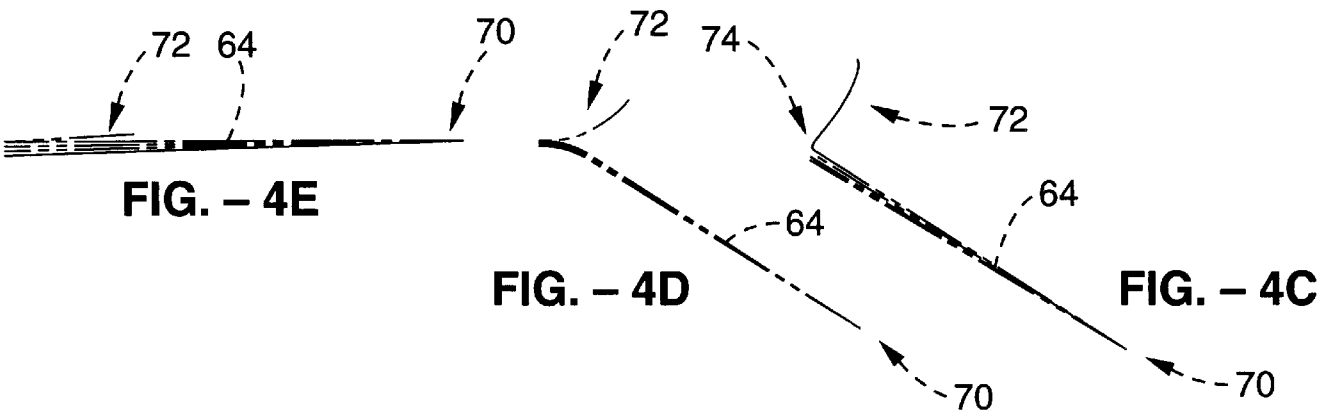
FIG. – 4C
FIG. – 4D
FIG. – 4E

FOLDING APPARATUS

BACKGROUND OF THE INVENTION

1. Field of the Invention

The invention pertains generally to systems and methods for folding paper sheets, and more particularly to a folder ejector apparatus for high speed folding of a plurality of stacked or collated sheets or pages for envelope insertion wherein one or more of the plurality of sheets is longer than the others.

2. Description of the Background Art

Periodic billing operations, such as the preparation and mailing of monthly billing statements to customers, require quick and efficient preparation and processing of large numbers of statements. Such billing statements each generally include a plurality of pages, sheets, or forms which must be printed, separated, organized, collated, folded, and inserted into envelopes.

Generally, each billing statement includes at least one page or form which is of greater length than the other pages in the statement. In one standard billing format, for example, the first or outer page of the billing statement is printed on an 8.5" by 14" sheet, while the remaining, inner pages in the statement comprise 8.5" by 11" sheets. The longer form generally includes a detachable portion that is removed along a perforation or indentation line by the billing recipient to leave an 8.5" by 11" sheet which is retained by the recipient for record-keeping. The detached portion, together with a payment, is then returned by mail to the biller.

A variety of folding systems and devices for mail preparation are known and used for high speed folding of a plurality of sheets or pages in a manner suitable for subsequent envelope insertion. Typically, a mail or billing statement is folded in half or in thirds by a buckle folder or other conventional folding device to provide a folded statement suitable for insertion into standard billing envelopes.

An important drawback in the currently known folding systems and devices, however, is the inability to accurately fold statements containing a plurality of sheets with one or more sheets of greater length than the others, as in the aforementioned standard billing format. When such a statement has been folded once to produce a folded 8.5" by 5.5" packet, there are still an additional three inches of the longer, outer sheet or form that protrude out from the 8.5" by 5.5" folded packet and which must be folded in order to fit into the envelope. A conventional buckle folder, in folding such a billing statement, cannot reliably fold over the three inch long detachable portion or tab of the longer, outer sheet into the 8.5" by 5.5" folded statement or packet without also causing unwanted folding of the tips of the inner, shorter sheets. When a plurality of 8.5" by 11" inner, sheets and one or more longer, outer sheets are registered along their front edges during collation and folded over, the back edges of the inner 8.5" by 11" sheets tend to extend out slightly past the eleven inch mark of the longer outer sheet in a shingling effect. Thus, as the extra portion (typically three inches) of the longer, outer sheet is folded over by a conventional buckle folder, the tips of the inner sheets are also folded. The folded tips of the inner statement detract from the overall appearance of the statement, which can cause customer dissatisfaction. The folded tips also interfere with the envelope insertion operation for the billing statements, since the folded tips may catch or jam in the machinery associated with conventional high speed envelope insertion, causing system shutdown and delay while the jam is cleared.

Accordingly, there is a need for a folding apparatus which can fold a billing statement having one or more sheets which are longer than the others without folding the tips of the shorter sheets, which performs folding operations quickly and efficiently, and which avoids system shutdowns due to improperly folded statements. The present invention satisfies these needs, as well as others, and generally overcomes the deficiencies present in the background art.

SUMMARY OF THE INVENTION

An object of the invention is to provide a folding apparatus which can accurately fold a plurality of pages or sheets of multiple lengths without causing unwanted folding of the tips of the shorter sheets.

Another object of the invention is to provide a folding apparatus which operates quickly and efficiently.

Still another object of the invention is to provide a folding apparatus which is operated by a system controller which monitors folding of the plurality of sheets by sensor means.

Yet another object of the invention is to provide a folding apparatus suitable for use in large volume, high speed processing of mail or billing statements.

Further objects of the invention will be brought out in the following portions of the specification, wherein the detailed description is provided for the purposed of fully disclosing the invention without placing limits thereon.

The subject invention is a folding apparatus which quickly and accurately folds mail or billing statements containing a plurality of sheets of multiple lengths. In general terms, the invention comprises a plurality of roller means for folding sheets, a plurality of gate means, adjacent to the roller means, and means for ejecting folded sheets out of the gate means and roller means. The invention also preferably comprises input means for providing sheets to the plurality of roller means, and output means for removing folded sheets from the plurality of roller means. The invention generally operates under the direction of computer control means, and preferably includes sensor means, interfaced with the control means, for detecting the location of sheets relative to the plurality of roller means and plurality of gate means.

By way of example and not of limitation, the roller means generally comprises a plurality of conventional folder rollers (such as those found in a traditional buckle folder) which may be adjustably positioned relative to each other, depending upon the type of folding operation to be carried out with the subject invention. The gate means preferably comprises one or more conventional folder gates and their associated gate assemblies, and are positioned adjacent to the folder rollers. The folder gates may be positionally adjusted according to a particular folding operation. The means for ejecting folded sheets out of the roller means and/or gate means preferably comprises a kicker plate coupled to an actuator, with the actuator being associated with one of the folder gates. The input means and output means preferably comprises standard belt and pulley driven document transport systems which are suitably positioned to provide sheets into the folder rollers and receive folded sheets therefrom. The control means is preferably a system control computer which directs actuation of the kicker plate. The sensing means are interfaced with the control means and generally comprise an encoder for timing of the kicker gate actuation based on rotational values, as well as a plurality of photocell sensors or equivalent devices located adjacent the input means, output means, and folder rollers, which track and verify the position of statements during folding.

In operation of the subject invention, the input document transport system provides a plurality of sheets, which have preferably been organized and collated, to the folder rollers. The plurality of sheets will generally be a mail or billing statement having at least one sheet which is generally longer than several shorter sheets, with the leading edges of the sheets being aligned or registered previously during collation. The sheets are received by a pair of folder rollers and directed along a folding path towards a first folder gate. As the leading edges of the sheets come into contact with the first folder gate, movement of the sheets in the direction of the gate is blocked, and the action of the folder rollers causes the sheets to buckle and fold. The folder rollers and folder gates may be adjustably positioned to control the folding path of the sheets and thus the location of the folds and number of folds produced. Preferably the folder rollers and folder gates are positioned to produce a folded packet which is generally folded in half, with the end of the longer sheet or sheets protruding out of the packet, as described above. The folded packet is then directed by a series of folder rollers, which passively engage or grip the statement, along the folding path towards the kicker plate or other ejecting means, upon which the folded edge of the packet comes into contact. The kicker plate blocks travel of the folded packet. The kicker plate, at the direction of the system controller, then ejects the folded statement, causing the protruding portion of the longer sheet or sheets to buckle and fold, preferably along a perforation, rather than be forced back into the folder rollers. The protruding portion of the longer sheet of the statement is thus folded by the ejecting action of the kicker gate. Following the action of the kicker gate, the shorter sheets of the statement are not gripped by the folder rollers, and therefor do not undergo unwanted folding. The control means tracks the position of the statement by monitoring the encoder, which informs the control means of the position of the machine cycle of the folder apparatus, and thus the position of the statement. The photocell sensor verify that statements have entered and exited the apparatus.

BRIEF DESCRIPTION OF THE DRAWINGS

The invention will be more fully understood by reference to the following drawings, which are for illustrative purposes only:

FIGS. 4A–4E show a billing statement undergoing steps of one folding operation which may be carried out with the present invention.

DETAILED DESCRIPTION OF THE PREFERRED EMBODIMENT

Figure 1:
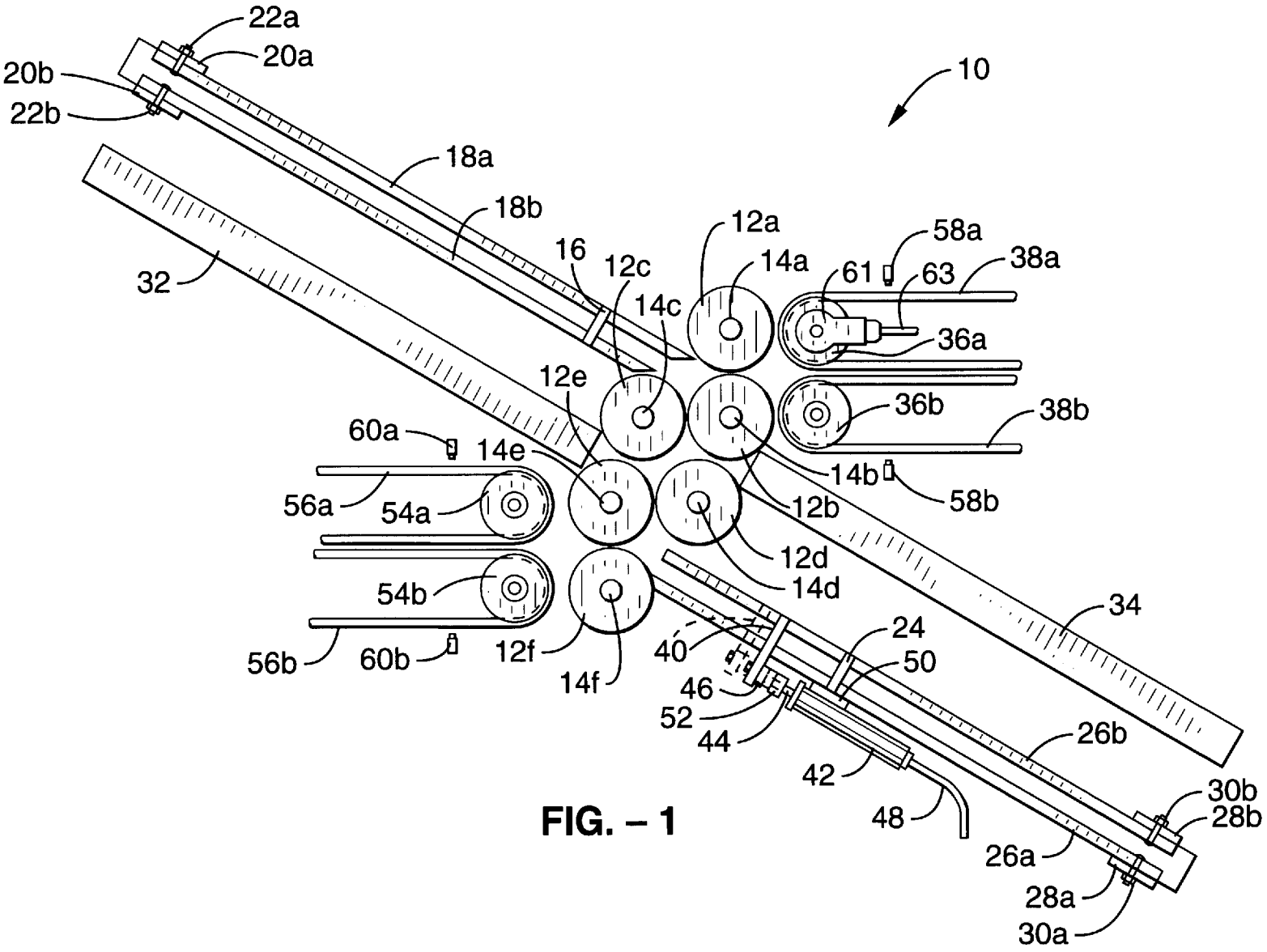
FIG. 1 s a side view of a folding apparatus in accordance with the present invention.
Figure 2:
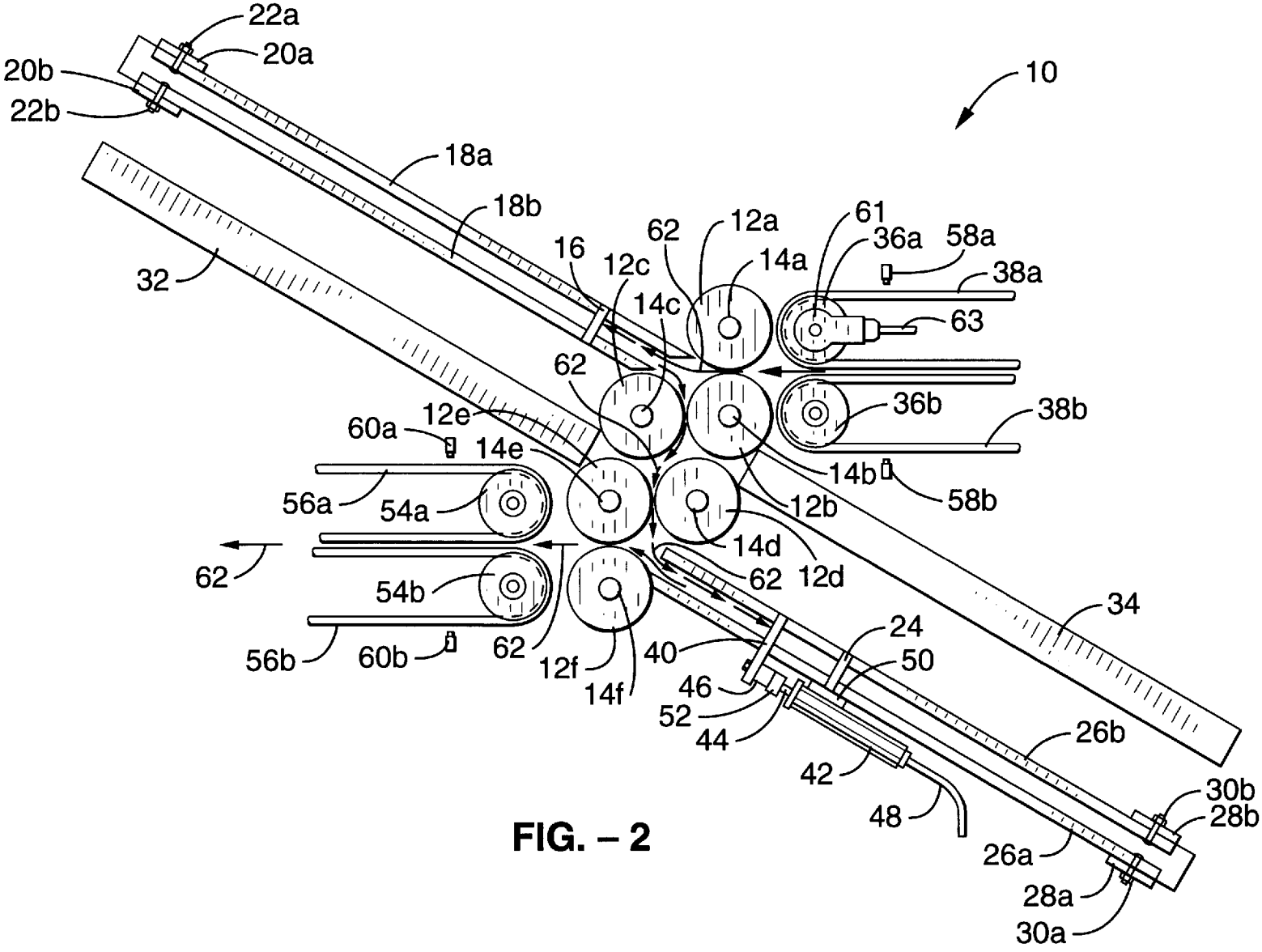
FIG. 2 is a side view of the folding apparatus of FIG. 1 showing a folding path.
Figure 3:
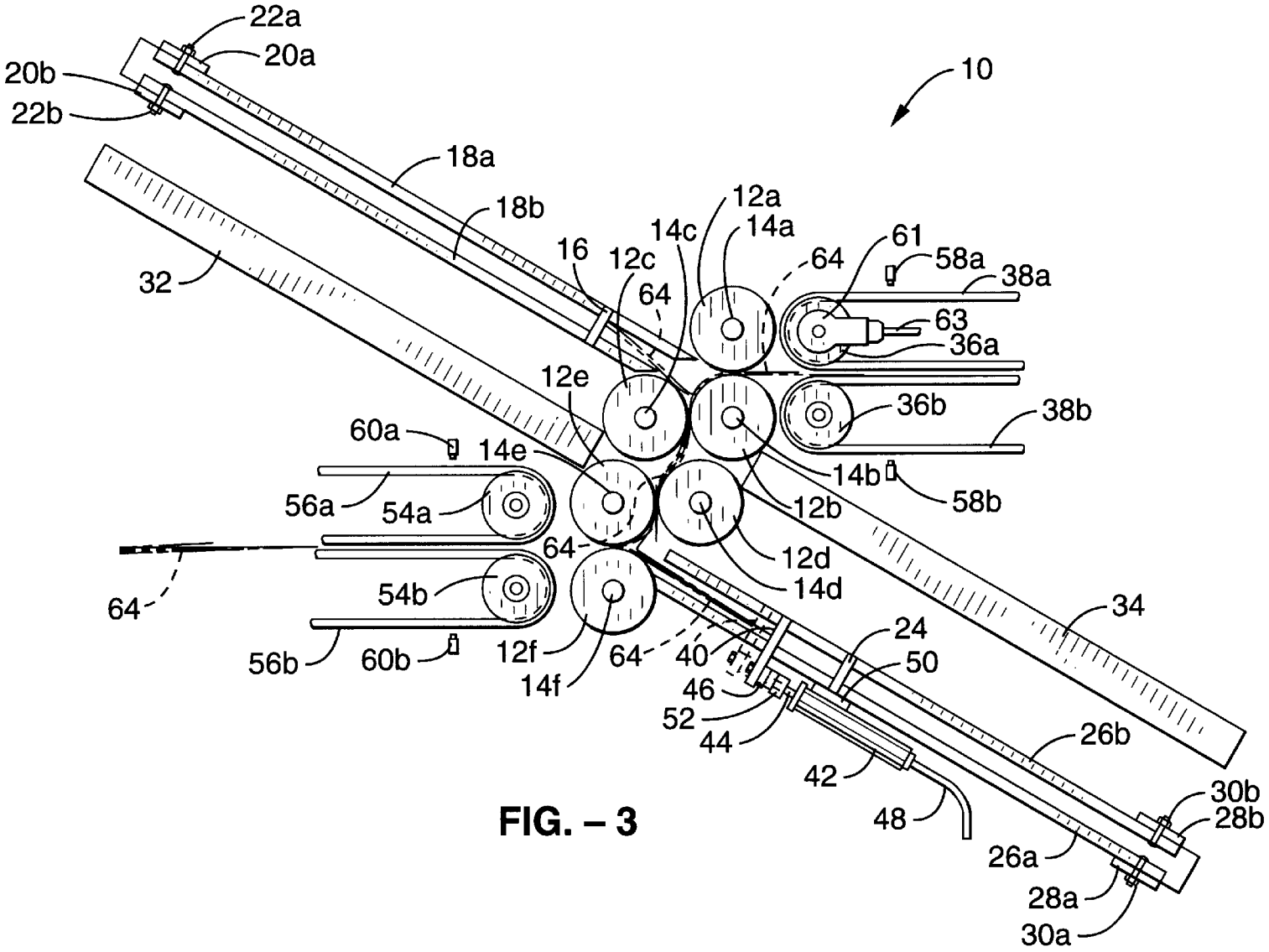
FIG. 3 is a side view of the folding apparatus of FIG. 1 illustrating generally the folding of a statement along a folding path.
Figure 5:
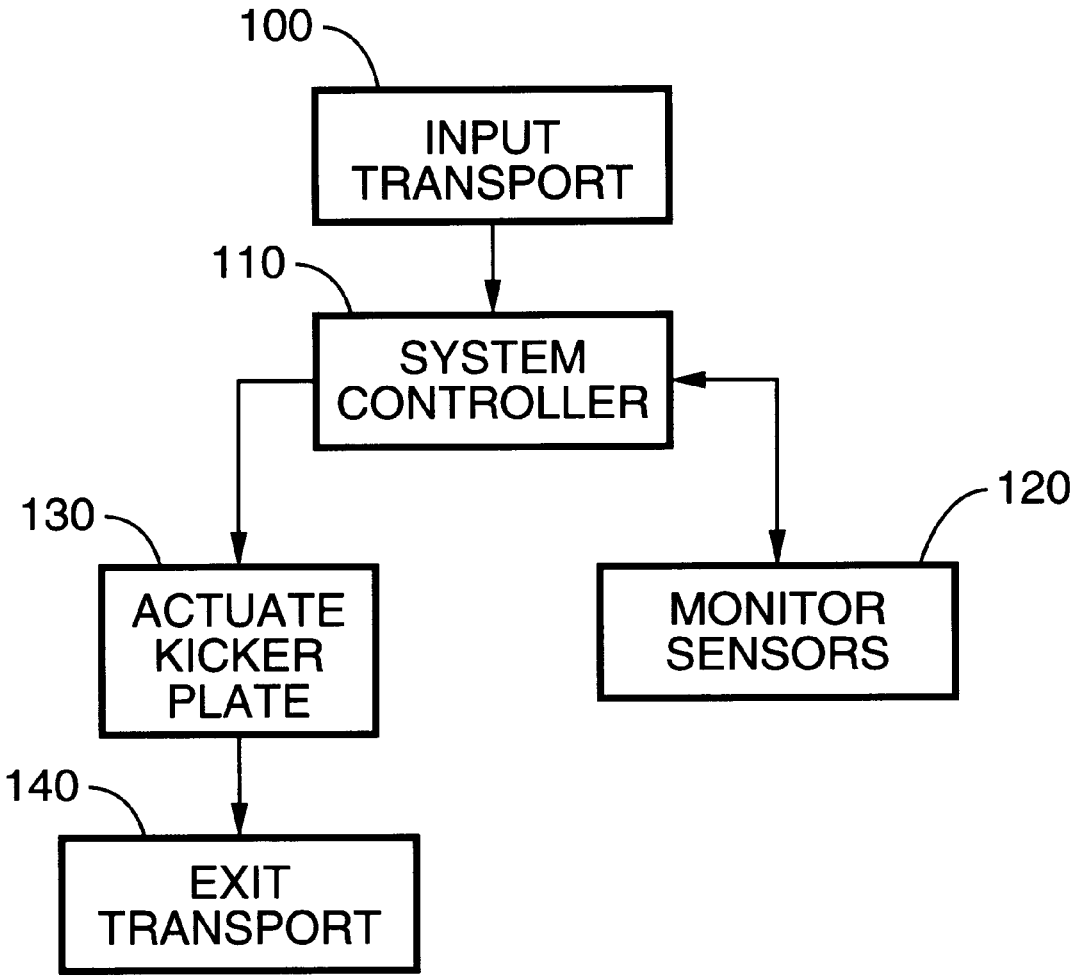
FIG. 5 is a flow diagram indicating a general control scheme for the folding apparatus comprising the present invention.

Referring more specifically to the drawings, for illustrative purposes the present invention is embodied in the folding apparatus which is shown generally in FIG. 1 through FIG. 3, the folding scheme shown in FIGS. 4A–4E, and the flow diagram of FIG. 5. The invention is described in terms of folding a standard billing statement which includes one longer sheet (usually the bottom or lower sheet, but the position may vary), together with several shorter or sheets, with the statement being folded for insertion into standard billing envelopes. However, as will be readily apparent to persons of ordinary skill in the art, a variety of folding operations and schemes, involving folding of multiple sheets of varying lengths and widths and which are arranged in many ways, may be carried out with the present invention. Similarly, it should be readily understood that the apparatus may vary as to configuration and as to details without departing from the basic concepts disclosed herein.

Referring first to FIG. 1 through FIG. 3, there is shown generally a folding apparatus 10 in accordance with the present invention which quickly and efficiently folds statements containing pages or sheets of multiple lengths. The term "statement" as used in this disclosure refers generally to a stack or packet of paper sheets, forms, or pages which have been organized and collated in a manner suitable for folding and insertion into envelopes. The folding apparatus 10 includes a plurality of roller means for folding sheets, which, in the preferred embodiment, comprise conventional folder rollers 12*a*, 12*b*, 12*c*, 12*d*, 12*e*, and 12*f*. Folder rollers 12*a*–12*f*, which are shown in end view in FIG. 1 through FIG. 3, are generally elongated cylinders of suitable length for folding paper sheets, which typically have widths of 6 and ⅝", 8.5" or other standard widths. Folder rollers 12*a*–12*f* have outer surfaces (not shown) with traction means for engaging paper sheets, as is standard in the art. Folder rollers 12*a*–12*f* are mounted on axles 14*a*–14*f* respectively, which are rotationally driven by conventional means. Standard adjustment means for positioning folder rollers 12*a*–12*f* are also generally included with the invention, and are omitted from the drawings for reasons of clarity.

The subject invention also comprises one or more gate means for folding sheets. A first gate means is shown as a folder gate 16 mounted in a conventional folder gate assembly with frame members 18*a*, 18*b* and adjustment means for positioning folder gate 16, shown generally as gate adjustment knobs 20*a*, 20*b*, which are mounted by screws 22*a*, 22*b* to frame members 18*a* and 18*b* respectively. The adjustment means for positioning folder gate 16 also generally comprises belts (not shown) which connect knobs 20*a*, 20*b* with folder gate 16 so that rotation of knobs 20*a*, 20*b* causes folder gate 16 to translate along frame members 18*a*, 18*b*. Other common adjustment means for positioning folder gate 16 may also be used with the invention. A second gate means includes folder gate 24 which, like the first gate means, is mounted in a conventional gate assembly with frame members 26*a*, 26*b* and gate adjustment knobs 28*a*, 28*b* mounted respectively thereon by screws 30*a*, 30*b*. Additional gate means for folding sheets into various configurations may be included with the invention, and are shown generally as gate assemblies 32, 34, which are identical to the first and second gate means as described above, and from which the details have been omitted for reasons of clarity. Means for ejecting folded sheets or statements out of a gate assembly and through a plurality of rollers are generally associated with one of the gate means, as described further below.

Input means for providing sheets or pages to folder rollers 12*a*–12*f* are generally included with the invention, and preferably comprise a conventional document transport system for paper sheets which includes upper pulleys 36*a* and lower pulleys 36*b*, and upper belts 38*a* and lower belts 38*b*. Upper and lower belts 38*a*, 38*b* form continuous, elongated loops which are associated with upper and lower pulleys 36*a* and 36*b* respectively at one end as well as a corresponding set of pulleys (not shown) at the other end of the elongated loops. Upper and lower pulleys 36*a*, 36*b* are positioned adjacent to each other and are spaced apart vertically at an appropriate distance so that standard paper sheets may be transported between upper and lower belts 38*a*, 38*b*, which frictionally engage the sheets. Upper and lower pulleys 36*a*, 36*b* and upper and lower belts 38*a*, 38*b* are rotationally driven by standard means (not shown), and are positioned so that the action of the upper and lower belts 38*a*, 38*b* transports or inputs paper sheets into folder rollers 12*a*–12*f*. Upper and lower belts 38*a*, 38*b* are generally made from an elastomeric material suitable for frictionally engaging paper sheets.

Other input means are also contemplated for use with the present invention. For example, paper sheets may be directed into folder rollers 12*a*–12*f* through a chute or channel by means of compressed air jets and/or vacuum sources, or other mechanical input means commonly used in the art. Compressed air jets and/or vacuum sources may additionally be used in conjunction with the belt and pulley input transport system described above, if desired.

Also included with the invention are means for ejecting or pushing folded sheets out of at least one gate means and through one or more folder rollers 12*a*–12*f*, in order to prevent undesired folding of the tips of the shorter sheets of a statement, as described above. In the preferred embodiment, the ejecting means comprises a kicker plate 40 which is slidably associated with the frame members 26*a*, 26*b* of the second gate means. Kicker plate 40 is moved or driven by suitable actuating means, which preferably comprise a compressed air actuator 42, which is coupled to kicker plate 40 by plunger rod 44 and connector member 46. Compressed air is supplied to actuator 42 via air line 48 which is connected to a compressed air source (not shown). Actuator 42 is attached to a base 50, with base 50 being mounted on frame member 26*a*. Actuator 42 and base 50 may alternatively be mounted directly onto gate 24. Actuator 42 may be driven by other means such as vacuum, electromagnetic force, and the like.

The ejecting means of the subject invention may alternatively or in combination comprise a block, bar, forked member, or other structure suitable for ejecting folded sheets. While kicker plate 40 is described and shown generally as associated with frame members 26*a*, 26*b* of the second gate means, this particular arrangement should not be considered limiting. Kicker plate 40 and actuator 42 could alternatively be associated with another gate means of the invention, or could be mounted on any suitable supporting structure wherein kicker plate 40 is positioned to push folded sheets through certain ones of the plurality of folder rollers 12*a*–12*f* as required to prevent unwanted folding of the tips of shorter sheets in a statement. Mounting the kicker plate 40 or other ejecting means directly onto the frame members of one of the gate means in the manner shown facilitates the construction and operation of the invention, and thus is the presently preferred arrangement. Kicker plate 40 is shown associated with frame members 26*a*, 26*b* of the second gate means in order to illustrate the use of the present invention with the particular folding operation described above. The location of kicker plate 40 or other ejecting means may thus be varied relative to folder rollers 12*a*–12*f*, depending upon the particular folding operation which is to be carried out with the invention.

Means for positionally adjusting kicker plate 40 are generally included with the subject invention, to allow control of the amount or level of pushing or ejection provided by kicker plate 40 to a folded document. A translational adjuster 52, associated with connector member 46, may be used to provide accurate positioning of kicker plate 40. Base 50 could also include sliding adjustment means for positioning actuator 42 and kicker plate 40. If base 50 is mounted directly onto gate 24, the position of kicker plate 40 and actuator 42 may be adjusted by the positioning of gate 24 by turning adjustment knobs 28*a*, 28*b*, as described above. Other adjustment means commonly used in the art may also be used for positionally adjusting kicker plate 40.

Folded sheets are removed from folder rollers 12*a*–12*f* by output means which preferably comprise a conventional document transport system with upper pulleys 54*a*, lower pulleys 54*b*, and upper belts 56*a* and lower belts 56*b*. As with the input transport system described above, belts upper and lower belts 56*a*, 56*b* form continuous, elongated loops which are associated with upper and lower pulleys 54*a* and 54*b* respectively at one end as well as a corresponding set of pulleys (not shown) at the other end. Upper and lower belts 56*a*, 56*b* frictionally engage the folded sheets or statements received from folder rollers 12*a*–12*f*, and transport them to other downstream mail processing operations, such as insertion of the folded statements into envelopes and postage metering.

The invention generally operates under the direction of computer control means, which is preferably a system controller computer as discussed further below in reference to FIG. 5. Preferably, sensor means, which are interfaced with the control means, detect the position or location of sheets before and after folding relative to the folder rollers 12*a*–12*f*, folder gate 16, and kicker plate 40. The sensor means preferably comprising encoder means such as a rotational shaft encoder 61, shown associated with pulley 36*a*, is included to provide timing information to the control means based on rotational values. Interface cable 63 connects encoder 61 with the control means. Generally pulleys 36*a*, 36*b* of the input means, pulleys 54*a*, 54*b* of the output means, and folder rollers 12–12*f* are driven by the same power source, such as an electric motor (not shown), and the monitoring by encoder 61 of the rotational angle of pulley 36*a* provides information for the overall machine cycle of the folding apparatus 10. Monitoring of the machine cycle of the folding apparatus 10 in this manner allows the controller means to activate kicker plate 40 at the correct time. Encoder 61 may alternatively be located on one or more of the folder rollers 12*a*–12*f*, or on one of the other pulleys 36*b*, 54*a*, 54*b* of the input or output means. The encoder means may also be included within the motor (not shown) that drives the folding apparatus 10, with the motor suitable interfaced with the control means.

The sensor means also preferably comprises a first photoemitter and photodetector 58*a*, 58*b* positioned generally adjacent to the input means of the invention, and a second photoemitter and photodetector 60*a*, 60*b* positioned generally adjacent to the output means of the invention. The invention, however, may be operated without such sensing means.

Referring now to FIG. 4A through FIG. 4E as well as FIG. 2 and FIG. 3, the use of the present invention for folding a standard billing statement with one long sheet and one shorter sheet is generally illustrated. As stated above, the invention may be used for a variety of folding operations involving various collections of sheets or pages of multiple widths and lengths. Thus, the example described herein and shown generally in FIGS. 4A through 4E is merely for illustrative purposes.

Referring first to FIG. 2, there is shown a folding path 62 in accordance with the illustrative example mentioned above. Folding path 62 is obtained by adjusting the positions of folder rollers 12*a*–12*f* and folder gate 16 and kicker plate 40 generally to the positions shown in FIG. 2 and FIG. 3. Different positioning of the folder rollers 12*a*–12*f* and the folder gate means may be used for different folding operations.

Referring more particularly FIG. 2, FIG. 3, and FIG. 4A through FIG. 4E, there is shown a mail statement 64 undergoing folding according to configuration of folder rollers and folder gates shown in FIG. 2 and FIG. 3.

In FIG. 4A, statement 64 is shown to include a longer sheet 64*a* and a shorter sheet 64*b*. Statement 64 is provided to the folder rollers 12*a*–12*f* by the belts 38*a*, 38*b* and pulleys 36*a*, 36*b* of the input means, with sheets 64*a*, 64*b* registered or aligned at the front or leading edge 66 of statement 64. Statement 64 is directed by the input means to a first pair of folder rollers 12*a*, 12*b*, which grab statement 64 and direct it towards folder gate 16. When front edge 66 of statement 64 comes into contact with folder gate 16, a buckle 68 is formed in the statement 64 by the action of rollers 12*a*, 12*b*, and statement 64 is directed through rollers 12*b*, 12*c* wherein statement 64 undergoes folding.

As statement 64 passes between rollers 12*b* and 12*c*, it is folded generally in half, as shown in FIG. 4B, so that statement 64 has a folded leading edge 70 and a protruding tail 72 due to the longer sheet 64*a* (FIG. 4A). Statement 64 is passed along folder path 62 by folder rollers 12*b*, 12*c*, through rollers 12*d*, 12*e*, and towards kicker plate 40 which is mounted on frame members 26*a*, 26*b* of the gate assembly of the second gate means. When the leading, folded edge 70 comes into contact with kicker gate 40, further travel in that direction is prevented. The statement will stay in this position until kicker plate 40 is actuated, ejecting or pushing the statement into rollers 12*e*, 12*f*. Folder rollers 12*b*, 12*c*, and 12*d*, which passively engage statement 64 along folding path 62, prevent statement 64 from being forced back up into those folder rollers.

Kicker plate 40 is actuated by actuator 42 under the direction of the control means and according to the monitoring of the position of statement by the sensor means, as discussed below. Kicker plate 40 moves in a direction generally parallel to frame members 26*a*, 26*b*, and the range of the motion of kicker plate is shown in dashed lines in FIG. 3 as well as FIG. 1. The action of kicker plate 40 pushes folded edge 70, which is now the trailing edge, and thereby ejects statement 64 through folder rollers 12*e*, 12*f*. During this process the protruding tail 72 is folded over, preferably along a perforation 74, and then creased by folder rollers 12*e*, 12*f* to provide a folded statement as shown generally in FIG. 4D.

After ejection by kicker gate 40 and passing through folder rollers 12*e*, 12*f*, statement 64 is folded as shown in FIG. 4E, with tail 72 generally parallel to the remainder of statement 64, to provide a folded configuration for statement 64 suitable for insertion into an envelope.

As related above, FIG. 2, FIG. 3, and FIG. 4A through FIG. 4E illustrate one of many possible folding operations which may be carried out with the present invention. The aforementioned folding operation is shown with sheets 64*a*, 64*b* (FIG. 4A) traveling along folding path 62 (FIG. 3) in a lengthwise manner, with shorter edges of sheets 64*a*, 64*b* serving as leading edges upon entering rollers 12*a*, 12*b*. However, in other possible folding schemes, the wider edges of sheets 64*a*, 64*b* could be the leading edges upon entering folder rollers 12*a*, 12*b*. In further possible folding scheme which may be carried out with the present invention, statement 64 could, for example, be folded into thirds prior to the folding of tail 70, rather than in half as shown in FIG. 3 and FIG. 4A through FIG. 4E, by appropriate positioning of the folder rollers 12*a*–12*f*, kicker plate 40, and the gate means of the invention. While the gate means 32, 34 shown in FIG. 1 through 3 are not used in the folding operation depicted in FIG. 3 and FIG. 4A through FIG. 4E, gate means 32, 34 may be used in other folding operations. Likewise, kicker gate 40, while shown as associated with frame members 26*a*, 26*b* of the second gate means, may alternatively be included with the second or third gate means 32, 34.

Referring now to FIG. 5, as well as FIG. 1 through FIG. 3, there is shown a flow diagram indicating a general control scheme for the folding apparatus 10, to further illustrate the preferred manner of using the invention. Generally, an input transport 100 is used to input statements into the folding apparatus 10. Input transport 100 preferably comprises a conventional document transporting system as described above.

Control means, shown generally as system controller 110, direct actuation of kicker gate 40 at the appropriate point in the folding operation, thereby avoiding unwanted folding of the tips of the shorter sheets of the statements, as described above. Sensor means are preferably interfaced with system controller 110 to allow detection and monitoring of the location of statements within apparatus 10. The sensor means is preferably in the form of shaft encoder 61, photoemitter and photodetector 58*a*, 58*b* associated with input transport 100, and photoemitter 60*a* and photodetector 60*b* associated with the output means of the invention.

The system controller 110 tracks the position of statements 64 by monitoring the encoder and sensors 120. Shaft encoder 61 provides rotational information regarding the machine cycle of the folder apparatus 10, which allows system controller to actuate kicker plate 130 at the correct time. Sensors 58*a*, 58*b* are monitored 120 by system controller 110 to verify that a statement 64 has entered folding apparatus 10, and monitoring of sensors 60*a*, 60*b* similarly provides verification that statement 64 has cleared the apparatus 10. If a statement 64 has not properly entered or cleared the apparatus 10, system controller 110 is so notified, and may shut down operation of the folder apparatus 10 and/or other mail processing operations to allow an operator to search for paper jams or other problems to detect the location of statements in apparatus 10.

When shaft encoder 61 indicates to system controller 110 that a statement is correctly positioned along folding path 62 (FIG. 2), the system controller actuates the kicker plate 130, ejecting the folded statement through the final pair of rollers, which, in the illustrative example provided above, are folder rollers 12*e*, 12*f*.

Exit transport 140, which, as described above, is preferably a belt and pulley-type document transportation system, receives folded statements from folder rollers 12*a*–12f. Sensor photoemitter and photodetector 60*a*, 60*b*, are positioned adjacent exit transport 140, and verify that statement 64 has exited folder rollers 12*a*–12*f*, as related above. Exit transport 140 is generally interfaced with another mail statement or document processing system (not shown), such as an envelope insertion system.

Accordingly, it will be seen that the present invention provides a folding apparatus which quickly and effectively folds statements having sheets of multiple lengths without causing additional, unwanted folding of the tips of shorter sheets within the statement. Although the above description contains many specificities, these should not be construed as limiting the scope of the invention, but as merely providing illustrations of some of the presently preferred embodiments. Thus, the scope of the invention should be determined by the appended claims, and their legal equivalents.

What is claimed is:

1. A folding apparatus for simultaneously folding the entirety of a plurality of sheets, wherein a first sheet within the plurality of sheets having a perforation along a line and is longer than a second sheet within the plurality of sheets, comprising:

a) a plurality of roller means for folding the plurality of sheets, wherein said plurality of roller means comprises:

first, second, and third rollers wherein paired first and second said rollers actively engage and force buckling of the plurality of sheets and paired second and third said rollers actively engage and fold the plurality of sheets;

a forth roller that passively engages the plurality of sheets to prevent backup of the plurality of sheets and helps direct the plurality of sheets to paired fifth and sixth rollers; and said paired fifth and sixth rollers wherein said paired fifth and sixth rollers actively engage and fold the first sheet at the perforation line;

b) at least one depth adjustable gate means for preventing further progression along a path of movement of the plurality of sheets including a fold at the perforation line of the longer first sheet, wherein the plurality of sheets fits in said gate means without said plurality of roller means gripping the plurality of sheets, said gate means adjacent to said fifth and sixth rollers of said plurality of roller means and adjusted to have a depth that accepts the longer first sheet; and c) means for ejecting folded sheets through one of said plurality of roller means, thereby causing upon ejection said fold at the perforation line of the longer first sheet, wherein said means for ejecting immediately precedes said fifth and sixth rollers.

2. A folding apparatus according to claim 1, further comprising control means for directing said ejecting means to eject upon completion of an operation and includes sensor means to track and verify the position of the plurality of sheets relative to said ejecting means, wherein said sensor means comprises:

an encoder for timing said ejecting means based on encoder determined rotational values for the folding apparatus and a plurality of photocell sensors located adjacent said roller means, said gate means, and said ejecting means which track and verify the position of the plurality of sheets during folding.

3. A folding apparatus for simultaneously folding the entirety of a plurality of sheets, wherein a first sheet within the plurality of sheets having a perforation along a line and is longer than a second sheet within the plurality of sheets, comprising:

a) a plurality of roller means for folding the plurality of sheets, wherein said plurality of roller means comprises:

first, second, and third rollers wherein paired first and second said rollers actively engage and force buckling of the plurality of sheets and paired second and third said rollers actively engage and fold the plurality of sheets;

a forth roller that passively engages the plurality of sheets to prevent backup of the plurality of sheets and helps direct the plurality of sheets to paired fifth and sixth rollers; and said paired fifth and sixth rollers wherein said paired fifth and sixth rollers actively engage and fold the first sheet at the perforation line;

b) a plurality of gate means with at least one of said gate means being a depth adjustable gate means for preventing further progression along a path of movement of the plurality of sheets including a fold at the perforation line of the first sheet, wherein the plurality of sheets fits in said gate means without said plurality of roller means gripping the plurality of sheets, said gate means positioned adjacent said fifth and sixth rollers of said roller means and said depth adjustable gate means adjusted to have a depth that accepts the longer first sheet;

c) a kicker plate, said kicker plate associated with at least one of said gate means, said kicker plate positioned to push folded sheets through said fifth and sixth rollers; and d) means for actuating said kicker plate, thereby causing upon being pushed through said fifth and sixth rollers said fold at the perforation line of the longer first sheet.

4. A folding apparatus according to claim 3, further comprising system control means for directing operation of said kicker plate to eject upon completion of an operation and includes sensor means to track and verify the position of the plurality of sheets relative to said kicker plate, wherein said sensor means comprises:

an encoder for timing said ejecting means based on encoder determined rotational values for the folding apparatus and a plurality of photocell sensors located adjacent said roller means, said gate means, and said ejecting means which track and verify the position of the plurality of sheets during folding.

5. A folding apparatus for simultaneously folding the entirety of a plurality of sheets, wherein a first sheet within the plurality of sheets having a perforation along a line and is longer than a second sheet within the plurality of sheets, comprising:

a) a plurality of folder rollers, wherein said plurality of folder rollers comprises:

first, second, and third rollers wherein paired first and second said rollers actively engage and force buckling of the plurality of sheets and paired second and third said rollers actively engage and fold the plurality of sheets;

a forth roller that passively engages the plurality of sheets to prevent backup of the plurality of sheets and helps direct the plurality of sheets to paired fifth and sixth rollers; and said paired fifth and sixth rollers wherein said paired fifth and sixth rollers actively engage and fold the first sheet at the perforation line;

b) at least one depth adjustable folder gate for preventing further progression along a path of movement of the plurality of sheets including a fold at the perforation line of the longer first sheet, wherein the plurality of sheets fits in said folder gate without said plurality of folder rollers gripping the plurality of sheets, said folder gate positioned adjacent said fifth and sixth rollers of said plurality of folder rollers and adjusted to have a depth that accepts the longer first sheet;

c) a kicker plate, said kicker plate associated with at least one said folder gates and positioned to push folded sheets through said fifth and sixth rollers; and d) an actuator, said actuator coupled to said kicker plate, whereby when said actuator is actuated, said kicker plate ejects said plurality of sheets through said fifth and sixth rollers thereby folding the longer first sheet at the perforation line.

6. A folding apparatus according to claim 5, further comprising a system controller computer, said system controller computer interfaced with said actuator wherein said system controller computer monitors by means of an encoder measuring rotational positions in the folding apparatus and a plurality of photocell sensors located adjacent said rollers, said gate, and said kicker plate which track and verify the position of the plurality of sheets during folding the plurality of sheets for location and activates said actuator at an appropriate time.

* * * * *